US006923685B2

(12) United States Patent
Holmes et al.

(10) Patent No.: US 6,923,685 B2
(45) Date of Patent: Aug. 2, 2005

(54) HANDLE LOCKING SYSTEM FOR ELECTRICAL CONNECTORS AND METHODS THEREOF

(75) Inventors: Liam Holmes, County Cork (IE); Martin O'Donnell, County Cork (IE)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 10/643,838

(22) Filed: Aug. 19, 2003

(65) Prior Publication Data

US 2004/0077205 A1 Apr. 22, 2004

Related U.S. Application Data

(60) Provisional application No. 60/404,558, filed on Aug. 19, 2002.

(51) Int. Cl.[7] ..... H01R 24/00
(52) U.S. Cl. ..... 439/660
(58) Field of Search ..... 439/660, 321, 439/333, 310–311, 368–370, 318, 568

(56) References Cited

U.S. PATENT DOCUMENTS 6,010,369 A * 1/2000 Itabashi et al. ..... 439/660
6,368,133 B1 * 4/2002 Zeiler et al. ..... 439/321
2002/0115353 A1 * 8/2002 Zeiler et al. ..... 439/660

* cited by examiner

*Primary Examiner*—J. F. Duverne
(74) *Attorney, Agent, or Firm*—Nixon Peabody LLP

(57) ABSTRACT

An electrical connection system includes a first electrical connector, a second electrical connector and a locking device. The first electrical connector has a first housing with one or more locking indents. The second electrical connector has a second housing with one or more slots. Each of the slots in the second housing is in alignment with one of the locking indents in the first housing when the second electrical connector is coupled to the first electrical connector. The locking device has one or more arms and each of the arms has one or more projections. Each of the projections extends into one of the locking indents in the first housing through one of the slots in the second housing when the locking device is seated over at least a portion of the second housing to lock the first electrical connector to the second electrical connector.

41 Claims, 2 Drawing Sheets

HANDLE LOCKING SYSTEM FOR ELECTRICAL CONNECTORS AND METHODS THEREOF

This application claims the benefit of U.S. Provisional Patent Application Ser. No. 60/404,558 filed Aug. 19, 2002 which is herein incorporated by reference in its entirety.

FIELD OF THE INVENTION

This invention relates generally to electrical connectors and, more particularly, a handle locking system for electrical connectors.

BACKGROUND OF THE INVENTION

A variety of different types of electrical connectors are used to couple electrical leads together. Unfortunately, one of the problems with existing electrical connectors, such as Euro DIN connectors, is that with vibration the electrical connectors can easily disconnect.

SUMMARY OF THE INVENTION

An electrical connection system in accordance with embodiments of the present invention includes a first electrical connector, a second electrical connector, and a locking device. The first electrical connector has a first housing with one or more slots and the second electrical connector has a second housing. The locking device locks the first electrical connector to the second electrical connector when the locking device is seated over at least a portion of the first housing and extends through the slots to engage the second housing.

A method for making an electrical connection system in accordance with embodiments of the present invention includes providing a first electrical connector having a first housing with one or more slots, providing a second electrical connector having a second housing, and providing a locking device. The locking device locks the first electrical connector to the second electrical connector when the locking device is seated over at least a portion of the first housing and extends through the slots to engage the second housing.

A method for securing an electrical connection in accordance with embodiments of the present invention includes connecting a first housing of a first electrical connector to a second housing of a second electrical connector. The first housing has one or more slots which provide openings to the second housing. A locking device is placed over at least a portion of the first housing so that a portion of the locking device extends through the slots to engage the second housing to lock the first electrical connector to the second electrical connector.

An electrical connection system in accordance with embodiments of the present invention includes a first electrical connector, a second electrical connector, and a locking device. The first electrical connector has a first housing with one or more locking indents. The second electrical connector has a second housing with one or more slots. Each of the slots in the second housing is in alignment with one of the locking indents in the first housing when the second electrical connector is coupled to the first electrical connector. The locking device has one or more arms and each of the arms has one or more projections. Each of the projections extends into one of the locking indents in the first housing through one of the slots in the second housing when the locking device is seated over at least a portion of the second housing to lock the first electrical connector to the second electrical connector.

A method of making an electrical connection system in accordance with embodiments of the present invention includes providing a first electrical connector having a first housing with one or more locking indents and a second electrical connector having a second housing with one or more slots. Each of the slots in the second housing is in alignment with one of the locking indents in the first housing when the second electrical connector is coupled to the first electrical connector. A locking device having one or more arms and each of the arms has one or more projections is provided. Each of the projections extends into one of the locking indents in the first housing through one of the slots in the second housing when the locking device is seated over at least a portion of the second housing to lock the first electrical connector to the second electrical connector.

A method of securing an electrical connection in accordance with embodiments of the present invention includes connecting a first housing of a first electrical connector to a second housing of a second electrical connector. The first housing has one or more one or more locking indents the second housing having one or more slots. Each of the slots in the second housing is in alignment with one of the locking indents in the first housing when the first and second housings are connected together. A locking device having one or more arms and each of the arms has one or more projections is placed over at least a portion of the second housing so that each of the arms extend through the slots to engage the first housing and each of the projections extends into one of the locking indents in the first housing through one of the slots in the second housing.

The present invention provides a complete and integrated locking system for electrical connectors. The locking system prevents the electrical connectors from coming apart in use and also provides a quick release for the electrical connectors. With the present invention, only an operator can release the lock which locks the electrical connectors together.

DETAILED DESCRIPTION

Figure 1:
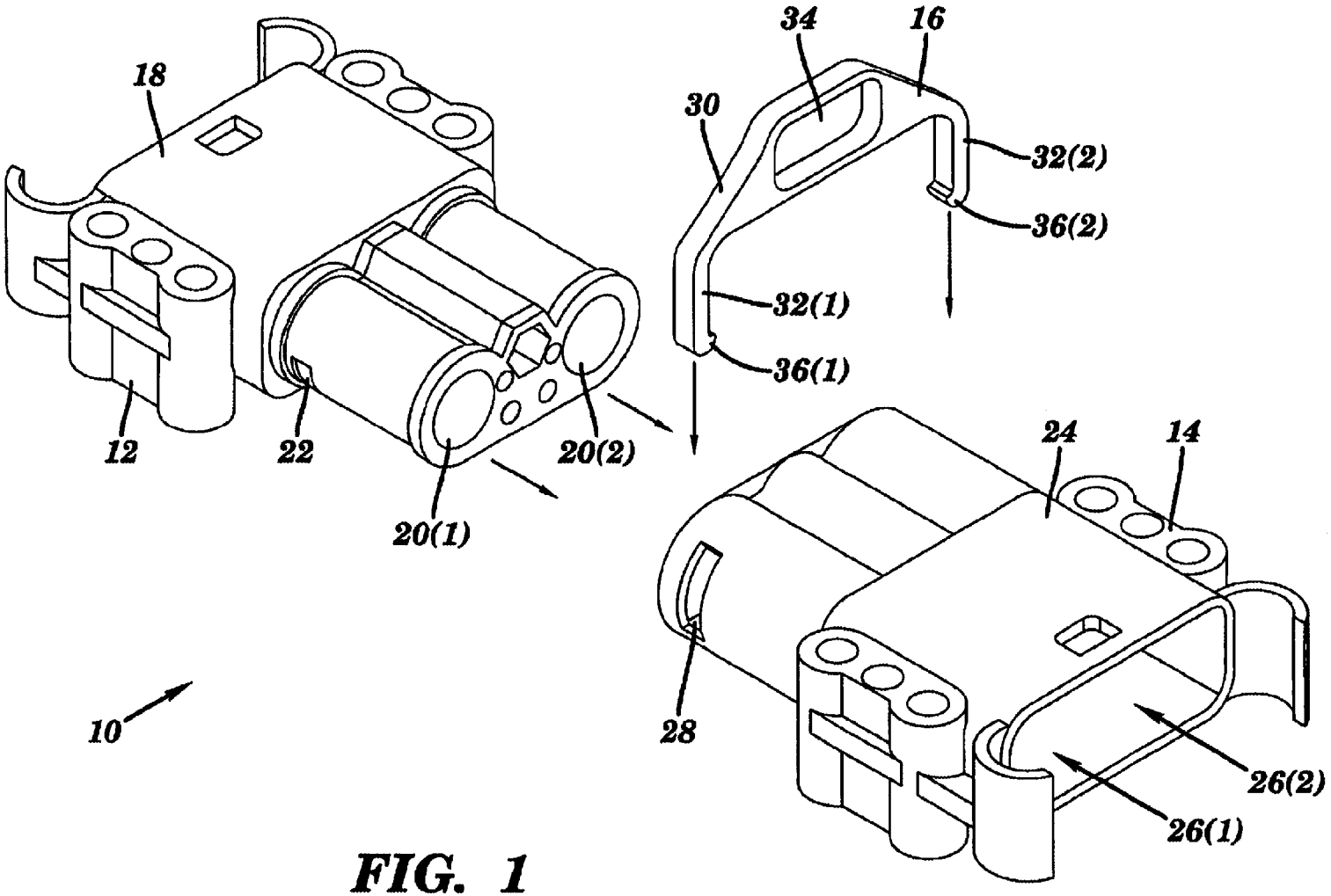
FIG. 1 is a perspective view of an electrical connection system with a handle locking system in an unlocked position and the first and second electrical connectors disconnected in accordance with an embodiment of the present invention.
Figure 2:
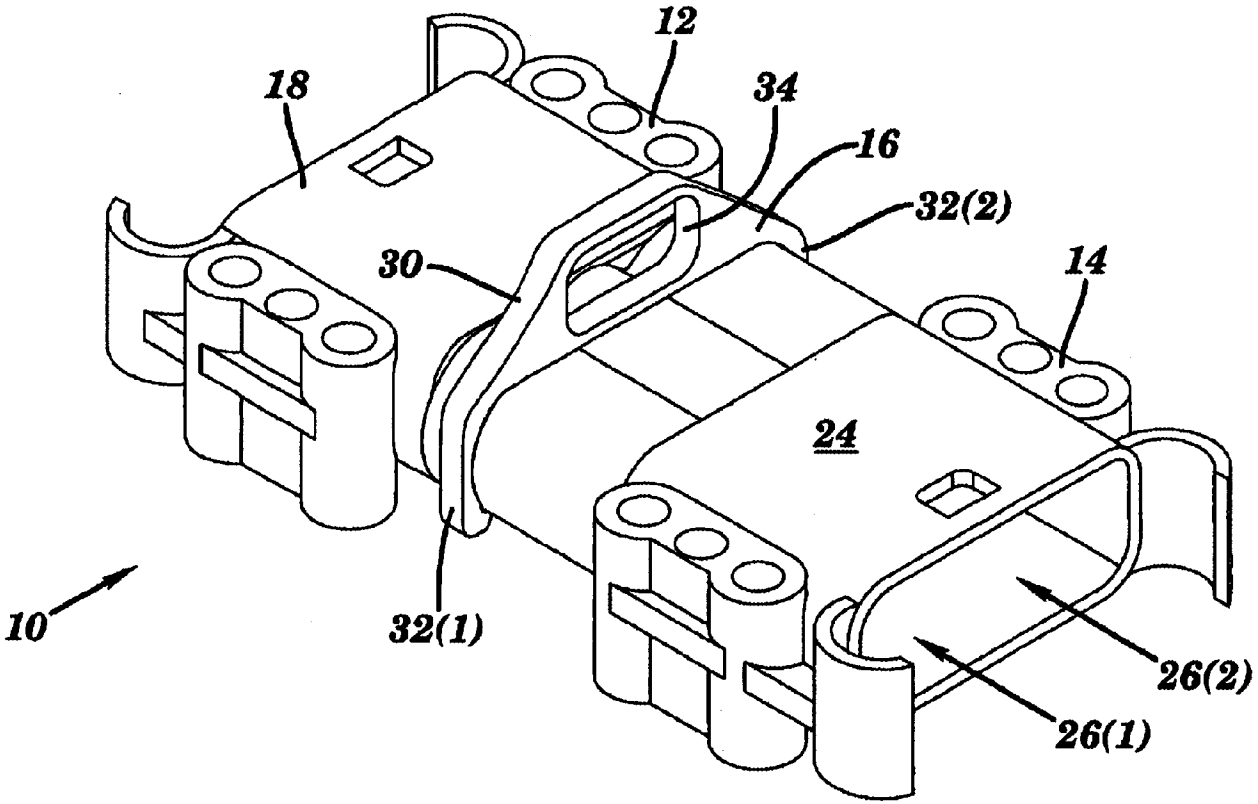
FIG. 2 is a perspective view of the electrical connection system with the first and second electrical connectors coupled together and the handle locking system in an locked position.

An electrical connection system 10 in accordance with embodiments of the present invention is illustrated in FIGS. 1 and 2. The electrical connection system 10 includes a first electrical connector 12, a second electrical connector 14, and a locking device 16, although the electrical connection system 10 may comprise other types, numbers, and combinations of components. The present invention provides a number of advantages including providing a complete and integrated locking system for electrical connectors.

Referring more specifically to FIGS. 1 and 2, the first electrical connector 12 include a first housing 18 with first passage 20(1) and 20(2) to receive first electrical leads, although the number, shape, and location of first passages to receive first electrical leads can vary. The electrical leads are secured within the first passages 20(1) and 20(2) in the first housing 18, although the first electrical leads can be coupled to the first housing 18 in other manners. Since the manner in which electrical leads are secured and coupled to an electrical connector are well know, it will not be described here. The first electrical connector 12 includes locking indents 22 formed in the housing on substantially opposing sides of the housing 18 which are used to lock the first electrical connector 12 to the second electrical connector 14, although the number, shape, and location of the locking indents 22 can vary. The locking indents 22 are used to help detachably secure the locking device 16 in place. A variety of different types of materials can be used to form the first electrical connector 12, such as metal.

The second electrical connector 14 includes a second housing 24 with second passages 26(1) and 26(2)to receive a second pair of electrical leads, although the number, shape, and location of second passages 26(1) and 26(2) to receive second electrical leads can vary. The second electrical leads are secured within the second passages 26(1) and 26(2) in the second housing 24, although the second electrical leads can be coupled to the second housing 24 in other manners. Again, since the manner in which electrical leads are secured and coupled to an electrical connector are well know, it will not be described here. The second electrical connector 14 includes rectangular shaped slots 28 which extend through the second housing 24 and are formed on substantially opposing sides of the second housing 24, although the number, shape, and location of slots 28 can vary. The slots 28 are formed in the second housing 24 to each be in alignment with one of the locking indents 22 when the first and second electrical connectors 12 and 14 are coupled together. The slots 28 are used by the locking device 16 to lock the second electrical connector 14 to the first electrical connector 12. A variety of different types of materials can be used to form the second electrical connector 14, such as metal.

The first electrical connector 12 is a male connector and the second electrical connector 14 is a female electrical connector and can be mated together to form an electrical connection, although other types of first and second electrical connectors can be used, such as genderless electrical connectors or other male and female connector configurations. Since the manner in which electrical connectors are coupled together to form an electrical connection and to couple leads coupled to each of the electrical connectors together is well know, it will not be described here When the first and second electrical connectors 12 and 14 are coupled together, each of the slots 28 is seated over and exposes one of the locking indents 22.

The locking device 16 has a central portion with a pair of arms 32(1) and 32(2) extending from the central portion 30 to form a U-shaped structure, although the locking device 16 can have other numbers of arms and can have other shapes and configurations. The width of the locking device 16 between the inside of arms 32(1) and 32(2) is slightly less than the width across the second housing 14 to provide a snug frictional fit when each of the arms 32(1) and 32(2) extend around a portion of the second housing 24. Each of the arms 32(1) and 32(2) is also formed to be flexible to permit the arms to bend to fit around a portion of the second housing 24. The size of a portion of the arms 32(1) and 32(2) is formed to fit into the into the slots 22 on opposing sides of the second housing 24 so that the arms 32(1) and 32(2) can extend through the slots 22 and frictionally engage the first housing 18 to secure the electrical connectors 12 and 14 together.

A triangular shaped projection 36(1) is located on the arm 32(1) and a triangular shaped projection 36(2) is located on the arm 32(1) and each of the projections 32(1) and 32(2) extend in a general direction towards the inside of the U-shaped structure, although the locking device 16 can have other numbers, types and shapes of projections. The triangular shaped projections 36(1) and 36(2) are shaped to mate with the indents 22 on substantially opposing sides of the first housing 18 when the arms 32(1) and 32(2) of the locking device 16 are positioned to extend through the slots 22 to detachably lock the electrical connectors 12 and 14 together.

The central portion 30 is used as a handle which can be used to put the locking device 16 on and to pull the locking device 16 off of the second housing 24. An opening 34 is formed in the central portion 30 to permit one or fingers of an operator to pass through to provide a better grip on the handle, although the central portion 30 can have other shapes and configurations.

The operation of the electrical connection system 10 will be described with reference to FIGS. 1 and 2. The male housing 18 of the first electrical connector 12 is mated with the female housing 24 of the second electrical connector 14 to electrically couple the first and second electrical connectors 12 and 14 together. This also couples the electrical leads in passages 20(1) and 20(2) to the electrical leads in passages 26(1) and 26(2) together. The housings 18 and 24 are connected together so that the slots 28 on substantially opposing sides of the second housing 24 are substantially aligned with the indents 22 on substantially opposing sides of the first housing 18.

Next, the locking device 16 is placed over and the arms 32(1) and 32(2) are positioned on opposing sides of the second housing 24. The locking device 16 is brought down towards the second housing 24 and when the arms 32(1) and 32(2) encounter the second housing 24 they bend outwardly around a portion of the second housing 24. With the handle 30, the arms 32(1) and 32(2) are positioned to extend into the slots 28 on substantially opposing sides of the second housing 24 and to frictionally engage with the outer surface of the first housing 18. This helps to lock the first electrical connector 12 to the second electrical connector 14.

With the handle 30, the arms 32(1) and 32(2) are also positioned in the slots 28 in the second housing 24 until the projections 36(1) and 36(2) on arms 32(1) and 32(2) mate with indents 22 formed on substantially opposing sides of the first housing 18. This detachably locks the locking device 16 in place to secure the first and second electrical connectors 12 and 14 together.

To unlock the first and second electrical connectors 12 and 14, the handle 30 is pulled in a direction away from the second housing 24. This causes the pulls the arms 32(1) and 32(2) up which disengages the projections 32(1) and 32(2) from the indents 22 on substantially opposing sides of the first housing 12. As the handle 30 continues to be pulled in a direction away from the second housing 24, the arms 32(1) and 32(2) are pulled put of the slots 28 on substantially opposing sides of the second housing 24.

When the locking device 16 has been removed from contact with the first and second housings 18 and 24, the first and second housings 18 and 24, can be pulled apart. Pulling apart the first and second housings 18 and 24 electrically disconnects the first electrical connector 12 from the second electrical connector 14.

Accordingly, with the present invention provides a complete and integrated locking system for electrical connectors. The locking device of the present invention is easy to use to lock and unlock the electrical connectors and is easy manufacture. Additionally, the present invention provides a locking system that provides a locking system that provides multiple locking engagements, in these particular embodiments through frictional engagement between the arms and the first housing through the slots and also by mating projections into locking indents to further secure the electrical connectors together.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. An electrical connection system comprising:

a first electrical connector having a first housing with one or more slots;

a second electrical connector having a second housing; and a locking device locks the first electrical connector to the second electrical connector when the locking device is seated over at least a portion of the first housing and extends through the slots to engage the second housing, wherein the locking device is detachable from the first and second electrical connectors.

2. The system as set forth in claim 1 wherein the second housing further comprises one or more locking indents, when the first electrical connector is coupled to the second electrical connector each of the slots in the first housing is in alignment with one of the locking indents in the second housing, the locking device extends through the slots into the locking indents to lock the first electrical connector to the second electrical connector.

3. An electrical connection system comprising:

a first electrical connector having a first housing with one or more slots;

a second electrical connector having a second housing; and a locking device locks the first electrical connector to the second electrical connector when the locking device is seated over at least a portion of the first housing and extends through the slots to engage the second housing;

wherein the locking device further comprises a central portion with a pair of arms extending from the central portion, the arms extending through the slots when the locking device is seated over at least a portion of the first housing.

4. The system as set forth in claim 3 further comprising a handle in the central portion.

5. The system as set forth in claim 4 wherein the handle comprises an opening in the central portion.

6. The system as set forth in claim 3 wherein each of the arms is flexible.

7. The system as set forth in claim 3 wherein the second housing further comprises one or more locking indents, when the first electrical connector is coupled to the second electrical connector each of the slots in the first housing is in alignment with one of the locking indents in the second housing, and a portion of each of the arms extend through the one of slots into one of the locking indents.

8. The system as set forth in claim 7 wherein each of the arms have one or more projections, each of the projections extends into and mates with one of the locking indents in the second housing through one of the slots in the first housing when the locking device is seated over at least a portion of the first housing to lock the first electrical connector to the second electrical connector.

9. The system as set forth in claim 1 wherein the first electrical connector is one of a male electrical connector and a female electrical connector and the second electrical connector is the other one of the male electrical connector and the female electrical connector.

10. The system as set forth in claim 1 wherein the locking device further comprises two or more arms and each of the arms extends through one of the slots in the first housing when the locking device is seated over at least a portion of the first housing to lock the first electrical connector to the second electrical connector.

11. A method for making an electrical connection system, the method comprising:

providing a first electrical connector having a first housing with one or more slots;

providing a second electrical connector having a second housing; and providing a locking device which locks the first electrical connector to the second electrical connector when the locking device is seated over at least a portion of the first housing and extends through the slots to engage the second housing, wherein the locking device is detachable from the first and second electrical connectors.

12. The method as set forth in claim 11 wherein providing the second electrical connector further comprises forming one or more locking indents in the second housing, each of the slots in the first housing is in alignment with one of the locking indents in the second housing when the first electrical connector is coupled to the second electrical connector, the locking device extends through the slots into the locking indents to lock the first electrical connector to the second electrical connector.

13. The method as set forth in claim 11 wherein the locking device further comprises two or more arms and each of the arms extends through one of the slots in the first housing when the locking device is seated over at least a portion of the first housing to lock the first electrical connector to the second electrical connector.

14. A method for making an electrical connection system, the method comprising:

providing a first electrical connector having a first housing with one or more slots;

providing a second electrical connector having a second housing; and providing a locking device which locks the first electrical connector to the second electrical connector when the locking device is seated over at least a portion of the first housing and extends through the slots to engage the second housing;

wherein the providing the locking device further comprises providing a central portion with a pair of arms extending from the central portion, the arms extending through the slots to the second housing when the locking device is seated over at least a portion of the first housing.

15. The method as set forth in claim 14 further comprising a handle in the central portion.

16. The method as set forth in claim 15 wherein the handle comprises an opening in the central portion.

17. The method as set forth in claim 14 wherein the providing the locking device further comprises forming each of the arms to be flexible.

18. The method as set forth in claim 14 wherein providing the second electrical connector having the second housing further comprises forming one or more locking indents in the second housing, when the first electrical connector is coupled to the second electrical connector each of the slots in the first housing is in alignment with one of the locking indents in the second housing and when the locking device is seated over at least a portion of the first housing a portion of each of the arms extend through the one of slots into one of the locking indents.

19. The method as set forth in claim 18 wherein the providing the locking device further comprises providing one or more projections on each of the arms, each of the projections extends into and mates with one of the locking indents in the second housing through one of the slots in the first housing when the locking device is seated over at least a portion of the first housing to lock the first electrical connector to the second electrical connector.

20. The method as set forth in claim 11 wherein the first electrical connector is one of a male electrical connector and a female electrical connector and the second electrical connector is the other one of the male electrical connector and the female electrical connector.

21. A method for securing an electrical connection, the method comprising:

connecting a first housing of a first electrical connector to a second housing of a second electrical connector, the first housing having one or more slots which provide openings to the second housing;

placing a locking device over at least a portion of the first housing so that a portion of the locking device extends through the slots to engage the second housing to lock the first electrical connector to the second electrical connector, wherein the locking device is detachable from the first and second electrical connectors.

22. The method as set forth in claim 21 wherein the locking device further comprises two or more arms and each of the arms extends through one of the slots in the first housing when the locking device is seated over at least a portion of the first housing to lock the first electrical connector to the second electrical connector.

23. The method as set forth in claim 21 wherein the second housing further comprises one or more locking indents and wherein the connecting the first housing of the first electrical connector to the second housing of the second electrical connector further comprises aligning each of the slots in the first housing with one of the locking indents in the second housing and wherein the placing the locking device over at least a portion of the first housing further comprises placing the locking device to extend through the slots into the locking indents to lock the first electrical connector to the second electrical connector.

24. A method for securing an electrical connection, the method comprising:

connecting a first housing of a first electrical connector to a second housing of a second electrical connector, the first housing having one or more slots which provide openings to the second housing;

placing a locking device over at least a portion of the first housing so that a portion of the locking device extends through the slots to engage the second housing to lock the first electrical connector to the second electrical connector;

wherein the locking device further comprises a central portion with a pair of arms extending from the central portion, placing a locking device over at least a portion of the first housing further comprises positioning the arms into the slots when the locking device is seated over at least a portion of the first housing.

25. The method as set forth in claim 24 further comprising a handle in the central portion.

26. The method as set forth in claim 25 wherein the handle comprises an opening in the central portion.

27. The method as set forth in claim 24 wherein each of the arms is flexible.

28. The method sat forth in claim 24 wherein the second housing further comprises one or more locking indents and wherein connecting the first housing of the first electrical connector to the second housing of the second electrical connector further comprises aligning each of the slots in the first housing with one of the locking indents in the second housing, and wherein placing a locking device over at least a portion of the first housing further comprises positioning a portion of each of the arms through the one of slots into one of the locking indents.

29. The method as set forth in claim 28 wherein each of the arms have one or more projections and wherein placing a locking device over at least a portion of the first housing further comprises positioning each of the projections into one of the locking indents in the second housing through one of the slots in the first housing.

30. An electrical connection system comprising:

a first electrical connector having a first housing with one or more locking indents;

a second electrical connector having a second housing with one or more slots, each of the slots in the second housing is in alignment with one of the locking indents in the first housing when the second electrical connector is coupled to the first electrical connector;

a locking device having one or more arms and each of the arms has one or more projections, each of the projections extends into one of the locking indents in the first housing through one of the slots in the second housing when the locking device is seated over at least a portion of the second housing to lock the first electrical connector to the second electrical connector.

31. The system as set forth in claim 30 wherein the locking device further comprises a central portion with a pair of the arms extending from the central portion and an opening in the central portion.

32. The system as set forth in claim 30 wherein each of the arms is flexible.

33. The system as set forth in claim 30 wherein the first electrical connector is one of a male electrical connector and a female electrical connector and the second electrical connector is the other one of the male electrical connector and the female electrical connector.

34. A method of making an electrical connection system, the method comprising:

providing a first electrical connector having a first housing with one or more locking indents;

providing a second electrical connector having a second housing with one or more slots, each of the slots in the second housing is in alignment with one of the locking indents in the first housing when the second electrical connector is coupled to the first electrical connector;

providing a locking device having one or more arms and each of the arms has one or more projections, each of the projections extends into one of the locking indents in the first housing through one of the slots in the second housing when the locking device is seated over at least a portion of the second housing to lock the first electrical connector to the second electrical connector.

35. The method as set forth in claim 34 wherein the locking device further comprises a central portion with a pair of the arms extending from the central portion and an opening in the central portion.

36. The method as set forth in claim 34 wherein each of the arms is flexible.

37. The method as set forth in claim 34 wherein the first electrical connector is one of a male electrical connector and a female electrical connector and the second electrical connector is the other one of the male electrical connector and the female electrical connector.

38. A method of securing an electrical connection, the method comprising:

connecting a first housing of a first electrical connector to a second housing of a second electrical connector, the first housing having one or more one or more locking indents the second housing having one or more slots, each of the slots in the second housing is in alignment with one of the locking indents in the first housing when the first and second housings are connected together; and placing a locking device having one or more arms and each of the arms has one or more projections over at least a portion of the second housing so that each of the arms extend through the slots to engage the first housing and each of the projections extends into one of the locking indents in the first housing through one of the slots in the second housing.

39. The method as set forth in claim 38 wherein the locking device further comprises a central portion with a pair of the arms extending from the central portion and an opening in the central portion.

40. The method as set forth in claim 38 wherein each of the arms is flexible.

41. The method as set forth in claim 38 wherein the first electrical connector is one of a male electrical connector and a female electrical connector and the second electrical connector is the other one of the male electrical connector and the female electrical connector.

* * * * *